US005529007A

United States Patent [19]

Fitzpatrick

[11] Patent Number: 5,529,007

[45] Date of Patent: Jun. 25, 1996

[54] AUTOMATICALLY BALLASTED SAILBOAT

[76] Inventor: John B. Fitzpatrick, 1894 Villa Ct., Homestead Village, Lancaster, Pa. 17603

[21] Appl. No.: 510,551

[22] Filed: Aug. 2, 1995

[51] Int. Cl.[6] ..... B63B 15/00

[52] U.S. Cl. ..... 114/39.1; 114/91; 114/124

[58] Field of Search ..... 114/124, 91, 39.1

[56] References Cited

U.S. PATENT DOCUMENTS

| | | | |
|---|---|---|---|
| 1,460 | 12/1839 | Purse et al. | 114/124 |
| 521,388 | 6/1894 | Pool | 114/124 |
| 559,983 | 5/1896 | McLean | 114/91 |
| 2,643,628 | 6/1953 | Sveinsson | 114/124 |
| 3,417,720 | 12/1968 | Covell, Jr. | 114/124 |
| 3,934,535 | 1/1976 | Culver | 114/124 |
| 3,972,300 | 8/1976 | Adamski | 114/124 |
| 4,501,215 | 2/1985 | Hart et al. | 114/39.1 |
| 4,539,926 | 9/1985 | Boffer | 114/124 |
| 4,867,089 | 9/1989 | Haigis | 114/124 |
| 4,986,202 | 1/1991 | Mourgue et al. | 114/124 |

*Primary Examiner*—Sherman Basinger
*Attorney, Agent, or Firm*—Martin Fruitman

[57] ABSTRACT

A sailboat without stays for the mast has automatic ballasting which uses a tilting main mast and a tilting pole that has weights traveling up it to counteract increasing wind force upon the sail. The mast and the pole tilt in opposite directions. Their angles are prescribed by a set of gears acting as a motion reversing means, so that as the wind force increases the tilt of the mast, the tops of the mast and pole separate. The weights move up the pole and away from the sailboat's centerline because they are attached to a line fixed to the top of the mast and directed down the pole by a pulley at the pole top. Therefore, as the mast and pole separate, the length of line hanging down the pole is shortened and the weights move up the tilted pole.

8 Claims, 6 Drawing Sheets

AUTOMATICALLY BALLASTED SAILBOAT

BACKGROUND OF THE INVENTION

This invention deals generally with the ballasting of ships and more specifically with using shifting weights which travel up a tilted auxiliary mast to counteract the wind forces on a sail.

The classic sailboat has stays to maintain the mast upright, and the sail is supported from the mast so that the boat heels or tilts when subjected to the force on the sail of the wind coming from either side of the boat. The tendency of a sailboat to heel is so ingrained in the art of sailing that little consideration is given to the possibility of preventing it.

There are, however, advantages to be gained from a boat which does not heel and which is always oriented essentially horizontally. The absence of heel permits the hull to be designed with a flat bottom because the flat bottom will always be oriented in approximately a horizontal plane. Furthermore, a flat bottom with a step aft can be designed to plane on the water, and therefore can attain lower drag in the water and higher speeds. A boat which does not heel because it includes automatically operated ballast also permits the crew the luxury of working the boat without the necessity of also being audibly controlled ballast which moves from one side of the deck to the other or even hangs over the sides to prevent the wind forces from capsizing the boat.

It has also always been assumed that all sailboats, even the smallest, require stays to keep the mast upright and straight against the wind force on the sail. However, a mast without lateral stays permits the use of much larger foresails which can be rigged to overlap the mainsail and extend below it almost to deck level, thus employing the venturi effect to advantage. This is one of the most significant advantages of the invention. Take for example the enormous jibs on the America Cup yachts where jibs supply most of the drive when pointing to windward, yet are precluded by the lateral stays from benefiting fully from the venturi effect.

SUMMARY OF THE INVENTION

The present invention furnishes a design for a sailboat which does not tend to heel and which includes no lateral stays for the mast, thus furnishing all the advantages of a planing hull and larger foresails to attain higher speeds than would otherwise be possible.

The absence of heel and of lateral stays is accomplished by the use of a main mast that is actually designed to tilt from the usual vertical orientation and by the use of a weighted auxiliary mast or pole which tilts in the direction opposite from the main mast. The mast is also interconnected with the tilting pole or with a fixed anchor point by a variable force device, such as a spring, so that as the the mast tilts farther from the vertical position, the force resisting its movement is increased.

The tilting pole applies a force to the mast because it has weights mounted upon it which lift off the deck when the mast and pole diverge. A line is attached high on the mast, passes through a pulley at the top of the pole, and down the pole to a weight riding in a track on the pole. Thus, as the top of the pole tilts farther from the the mast, the weight moves up the pole. The maximum tilt of both the mast and the pole is attained when the weight reaches the top of the pole and stretches the entire line between the top of the pole and the connection at the mast. In effect, the pole and the mast are in a state of dynamic tension, varying constantly and automatically as course and wind velocity alter.

The divergent tilting of the mast and pole essentially maintains the relationship of the pulley at the top of the pole relative to the attachment point of the weight line to the mast. This causes the force of the weight on the pole to always be applied as a nearly horizontal force high on the mast and thereby to counteract the wind force which is effectively applied to the mast at a location which is lower on the mast. The combined forces of the weight and the spring are selected to counteract the anticipated force on the sail. However, since the force of the weight acts with a greater lever arm than the force of the wind, the weight need not be as great as it otherwise would have to be.

The weight traveling up the pole serves not only to counteract the tilt of the mast, but also ballasts the boat. The tilting mast and the tilting weighted pole are related by a simple motion reversing means which causes the pole to tilt in the direction opposite from the tilt of the mast. In the preferred embodiment, the motion reversing means is a gear system which tilts the pole by the same angle as the mast tilts, although in the opposite direction, and the weight travels up the pole a distance equal to the separation of the top of the pole and the main mast. As the weight moves up the tilted pole it also moves horizontally to windward away from the keel of the boat and thereby counteracts the boat's tendency to heel. Individual units of weights can be added to or removed from the traveling weight holder in order to adjust the ballast for changes in sailing conditions.

Furthermore, the spring is installed as a retarding spring which acts between the bottom of the pole and the weight moving up the pole so that, as the effect of the weight is reduced due to the force vector caused by the tilted pole, the force of the retarding spring compensates for the reduced effect of the weight.

It is helpful to note that in a conventional sailboat the heel of the hull is countered by a shift of the center of buoyancy to leeward. This requires a beamy hull or a heavy keel if the vessel is not to capsize in a squall. The present invention, instead, moves the center of gravity to windward. This permits the designer to create a totally different hull design featuring finer lines. When this new design of boat tacks through the wind, the mast and pole reverse position automatically, and the dynamic tension adjusts itself to the new course and wind velocity.

The tilting mast thereby powers the traveling weight which furnishes variable and automatically controlled ballasting to counteract the torque of the wind on the sail that causes the boat to heel. It is this automatic ballasting which permits the flat bottom hull to remain horizontal and to plane on the water surface.

The present invention thereby provides a sailboat with larger and better located foresails and a planing hull which together permit the boat to attain faster speeds than have previously been available.

DETAILED DESCRIPTION OF THE INVENTION

Figure 1:
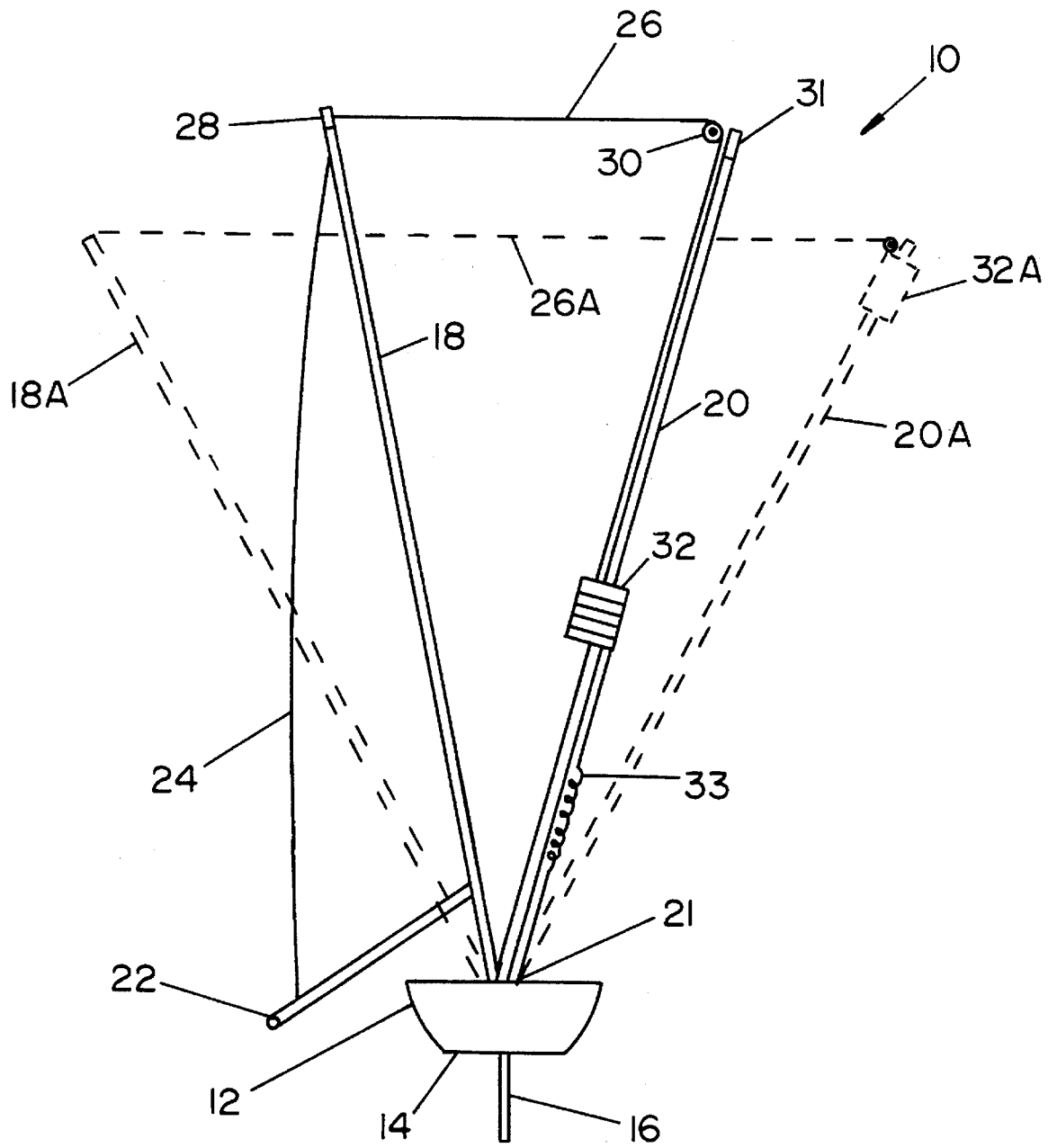
FIG. 1 is a simplified diagram of a view from the stern of a boat fitted with the preferred embodiment of the invention.

FIG. 1 is a highly simplified diagram of the view of the stern of a boat fitted with the preferred embodiment of the invention in which boat 10 includes hull 12 with flat bottom 14 and keel 16. The rigging on boat 10 includes tilting mast 18 and tilting weighted pole 20, but does not include the usual lateral stays which support conventional masts from either side. Mast 18 and pole 20 are each restricted in their tilting movement to planes which are perpendicular to keel 16 of hull 12. Mast 18 supports a conventional boom 22 and a sail 24. The sail and boom are shown in FIG. 1 in only simple outline form in order to better depict the invention.

Tilting mast 18 and tilting pole 20 are mounted at deck level with a gear reversing means (shown in FIG. 2) which causes pole 20 to tilt in the direction opposite to the tilt of mast 18, and mast 18 is always tilted to leeward (in the downwind direction) of the boat because of the force of the wind on sail 24. Tilting pole 20 is located just forward of mast 18 so that it does not interfere with the operation of boom 22 or sail 24. Cable 26 interconnects mast 18 and pole 20 because it is attached to mast 18 at swivel connector 28 on mast 18, and it passes through pulley 30, attached at swivel connector 31 near the top of pole 20, and down pole 20 to weight 32.

Since cable 26 is of a fixed length which is approximately equal to the height of pole 20, as mast 18 and pole 20 separate, weight 32 is pulled up toward the top of pole 20. When weight 32 reaches the top of pole 20, as shown in dashed lines by weight 32A at the top of pole 20A, cable 26A is stretched taut between mast 18A and pole 20A, and mast 18 and pole 20 can diverge no further.

Weight 32 offers particular benefits to boat 10. With the proper selection of weight, the force of weight 32 acting on cable 26 will counteract the wind force on sail 24 and thus pole 20 and weight 32 serve the same purpose that conventional stays do in preventing the mast from simply falling over when the wind force acts upon it.

Spring 33 aids in counteracting the wind force on mast 18. Spring 33 is connected between weight 32 and bottom 21 of pole 20 so that, as the effect of weight 32 is reduced due to the force vector caused by the tilting of pole 20, the force of spring 33 compensates for the reduced effect of weight 20.

Spring 33 is also used to actually increase the force counteracting the tilt of mast 18 as the angle of mast 18 to the vertical increases by selecting spring 33 to apply more force than is lost by the vector effect on weight 20. Although spring 33 is shown as a simple longitudinal spring attached between bottom 21 of pole 20 and weight 32, it should be apparent that the variable force on mast 18 can be applied by many other variable force means. For instance, spring 33 could be mounted between mast 18 and pole 20; it could be anchored to a fixed location rather than to the bottom of pole 20; or it could be configured as a coil which applies torque to mast pivot rod 34 (See FIG. 2). The means for applying increasing counteracting force to mast 20 could even be a torsion bar substituting for pivot rod 34.

The permitted tilt of mast 18 and the interacting and opposite tilt of pole 20, also serve another purpose for which tilting mast 18 acts as the motivating power. With pole 20 tilting farther to the windward as mast 18 tilts leeward, weight 32 acts as a shifting ballast as it moves up pole 20, and weight 32 thereby counteracts heeling of hull 12 just as crew members hanging over the windward side would. This action is emphasized by the dashed line positions shown in FIG. 1 which show pole 20A tilted so far that weight 32A is farther beyond the side of hull 12 than any crew member could ever be located.

Thus, tilting mast 18 is actually the motive force to automatically move weight 32 across the beam of boat 10 and thereby furnish the turning moment to counteract the heel caused by the wind force on sail 24.

However, at the same time, weight 32, along with spring 33, also acts as the force to maintain mast 18 sufficiently upright so that sail 24 is still effective. In this action of counteracting the wind force, tilting pole 20 serves the vital function of automatically reversing the direction of the counteracting force of weight 32 as changes in the direction of the wind require it.

In the preferred embodiment of the invention pictured in FIG. If, the following dimensions and parameters have been found to operate satisfactorily, but it should be understood that this is only one set of an infinite number of possibilities.

Hull length—15 feet length overall

Hull beam—5½ feet

Mast height—20 feet

Sail area—110 square feet (excluding a jib)

Height of weight on pole—13.5 feet

Movable weight—42 pounds

Spring force—21 pounds

Crew weight—180 pounds

Wind speed—approximately 18 miles per hour

Mast angle—30 degrees

Wind force—102 pounds

Turning moment on sail—285 foot-pounds

Figure 2:
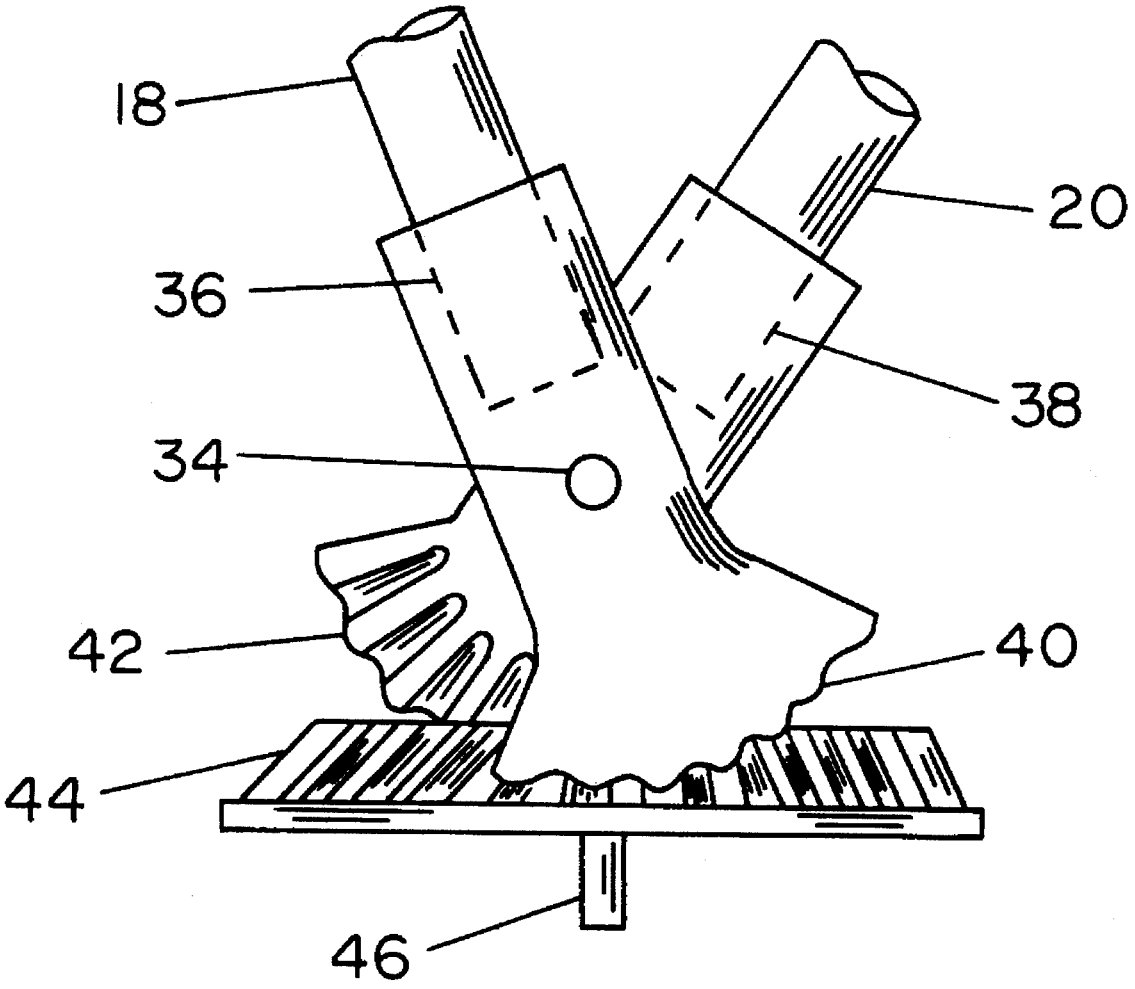
FIG. 2 is a rear view of a gear motion reversing means interconnecting the mast and the tilting pole at their bases.

FIG. 2 is a rear view of one of several simple mechanisms which can interconnect tilting mast 18 and tilting pole 20 and can be used to permit the automatic redirecting of the forces counteracting the wind.

In FIG. 2 mast 18 and pole 20 are each supported on pivot rod 34 by sockets 36 and 38 respectively. At the other ends of sockets 36 and 38, on the opposite sides of pivot rod 34 from mast 18 and pole 20, are located hypoid gear segments 40 and 42. Gear segments 40 and 42 each mesh with horizontal hypoid gear 44, with a circular pattern of teeth protruding toward gear segments 40 and 42. Gear segments 40 and 42 are spaced apart from each other, located at opposite sides of a diameter of gear 44, and each mesh with the teeth of gear 44. Thus, FIG. 2, a view from the stern of the boat, shows mast 18 and its gear 40 in front of pole 20 and its gear 42. It is quite apparent that with this gear arrangement, as mast 18 tilts in one direction it turns gear 44 on its axle 46, and that the rotation of gear 44 causes gear segment 42 and pole 20 to tilt in a direction opposite from mast 18.

Figure 3A:
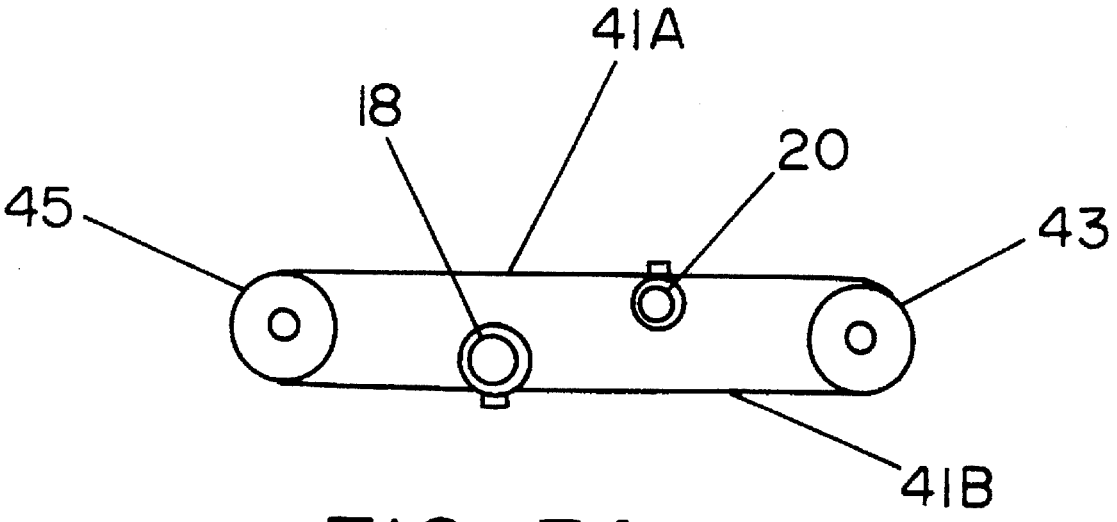
FIG. 3A is a schematic drawing of the top view of an alternate pulley motion reversing means for interconnecting the mast and the pole.
Figure 3B:
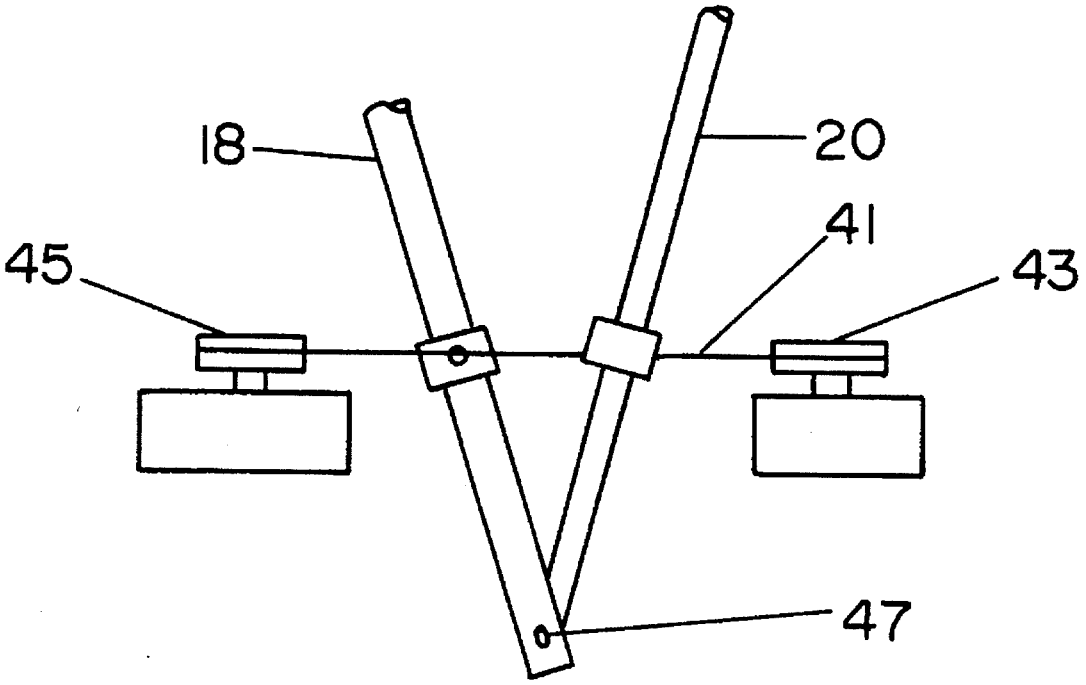
FIG. 3B is a schematic drawing of the side view of an alternate pulley arrangement for interconnecting the mast and the pole.

FIGS. 3A and 3B are simplified diagrams of an alternate motion reversing means to impart motion to pole 20 from the movement of mast 18 by the use of cable 41 moving around pulleys 43 and 45. FIG. 3A is the top view, and FIG. 3B is the side view of the same motion reversing means. Since the opposite lines 41A and 41B of cable 41 always move in opposite directions, it is only necessary to attach pole 20 to one line 41A and mast 18 to the other line 41B. Then, with the pivots 47 of mast 18 and pole 20 located at a different height on the mast and pole than the connections to cable 41, the pole will always move in the direction opposite from the motion of the mast. It is also interesting to note that when the pivot points of the pole and mast are located at different heights, the angle of motion of pole 20 can be greater or less than the angle of motion of mast 18.

Figure 4:
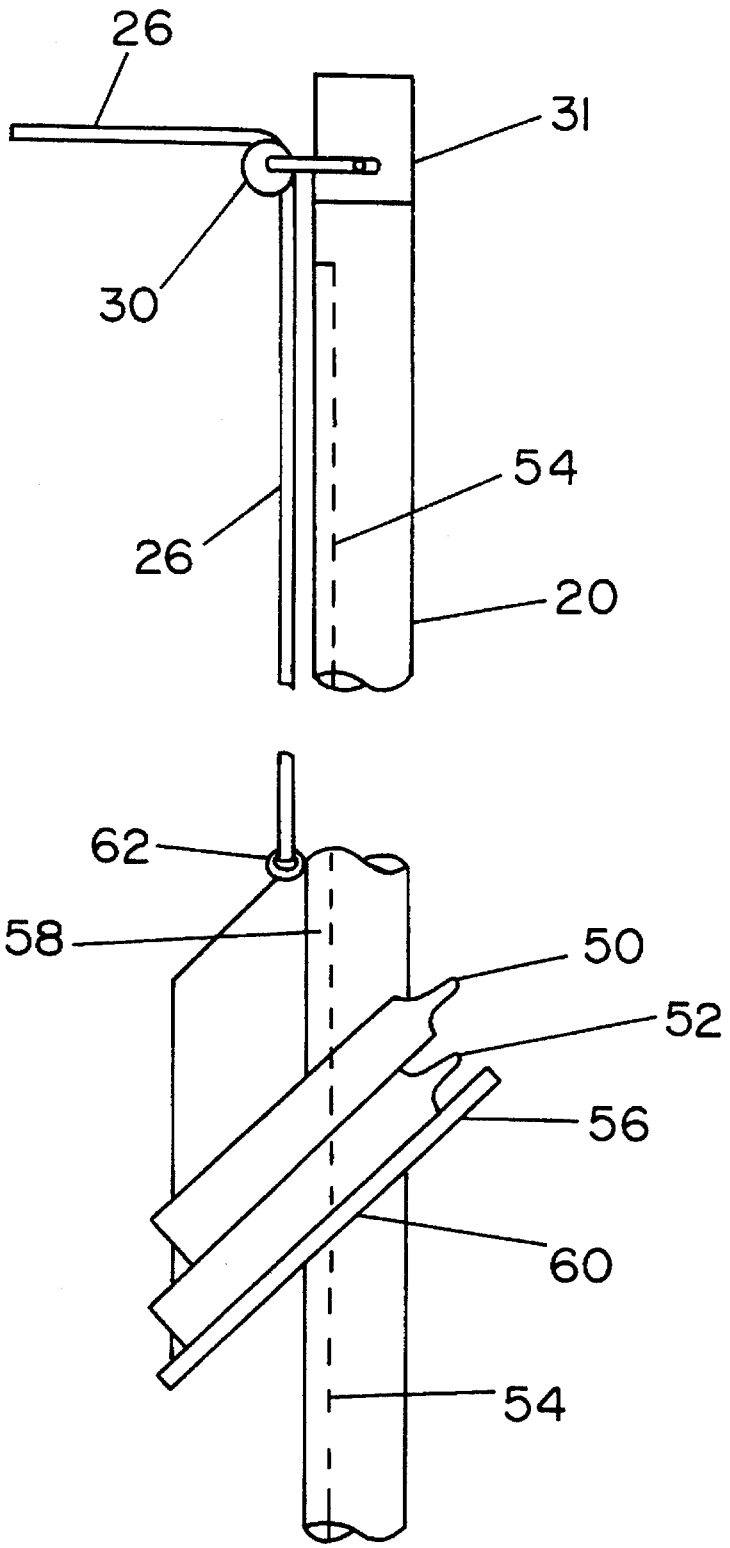
FIG. 4 is a side view of a preferred embodiment for supporting the weights on the tilting pole.

FIG. 4 depicts the preferred embodiment for the placement of weights 50 and 52 on pole 20 so that the total weight can be varied in selected increments. Variation of the total amount of weight on pole 20 is desirable so that a boat using the tilting mast and pole arrangement can be adjusted for use with varying wind conditions and for the direction of motion relative to the wind direction. Although FIG. 4 shows two removable weights 50 and 52, it is apparent that either more or fewer weights can be used.

As shown in FIG. 4 with dashed lines, pole 20 includes longitudinal slot 54 running over most of its length. Weight platform 56 (shown in perspective in FIG. 5) includes a segment 58 which fits into slot 54 and a hole 60 through which pole 20 is inserted. Weight platform 56 therefore can slide up and down along pole 20 but is locked into slot 54 so that it will not twist around on pole 20. Weight platform 56 is raised on pole 20 as pole 20 tilts away from mast 18 (FIG. 1), so that more of cable 26, whose length is fixed, is used up between the mast and pulley 30 at the top of pole 20 and less of cable 26 is available to hang down along pole 20. Pulley 30 is attached at the top of pole 20 at swivel fitting 31, so that the orientation of pulley 30 will adjust to accommodate to the change of location of pole 20 to either side of mast 18.

Figure 5:
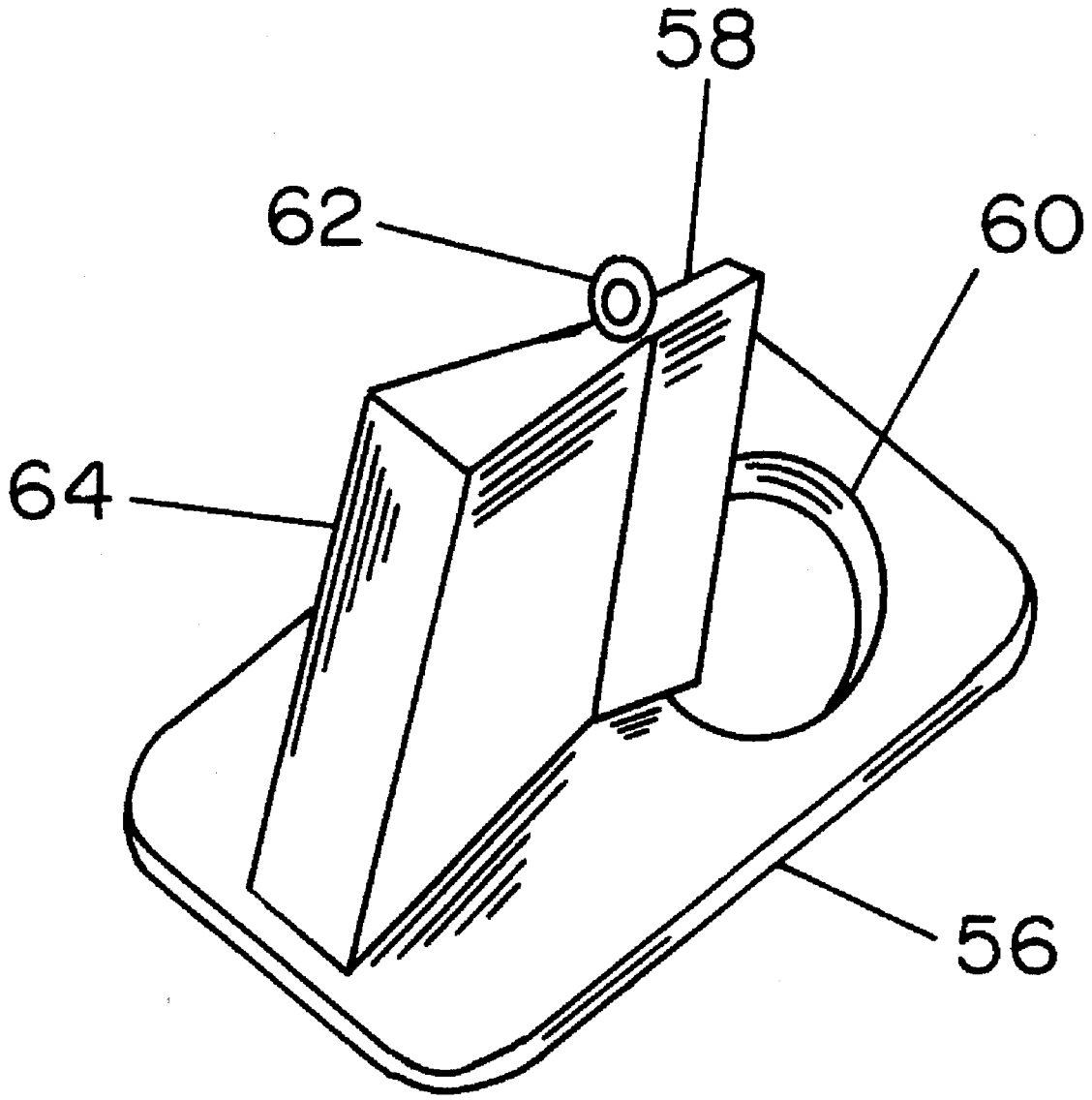
FIG. 5 is a perspective view of the platform for supporting weights in the preferred embodiment.

FIG. 5 is a perspective view of weight platform 56 to facilitate better understanding of its structure. Segment 58, which fits into slot 54 on pole 20 (FIG. 4), is attached to platform 56 and protrudes from the top surface of platform 56. Hole 60 is dimensioned so that pole 20 will fit through it, and hole 60 is located offset from the center of platform 56. This offset permits the centers of gravity of weights 50 and 52 (FIG. 4) to be located close to the area of platform 56 which is under ring 62 to which cable 26 (FIG. 4) is attached. Weights 50 and 52 are essentially horseshoe shaped plates so that they will fit around pole 20 and centerpiece 64 which protrudes up from weight platform 56.

Figure 6:
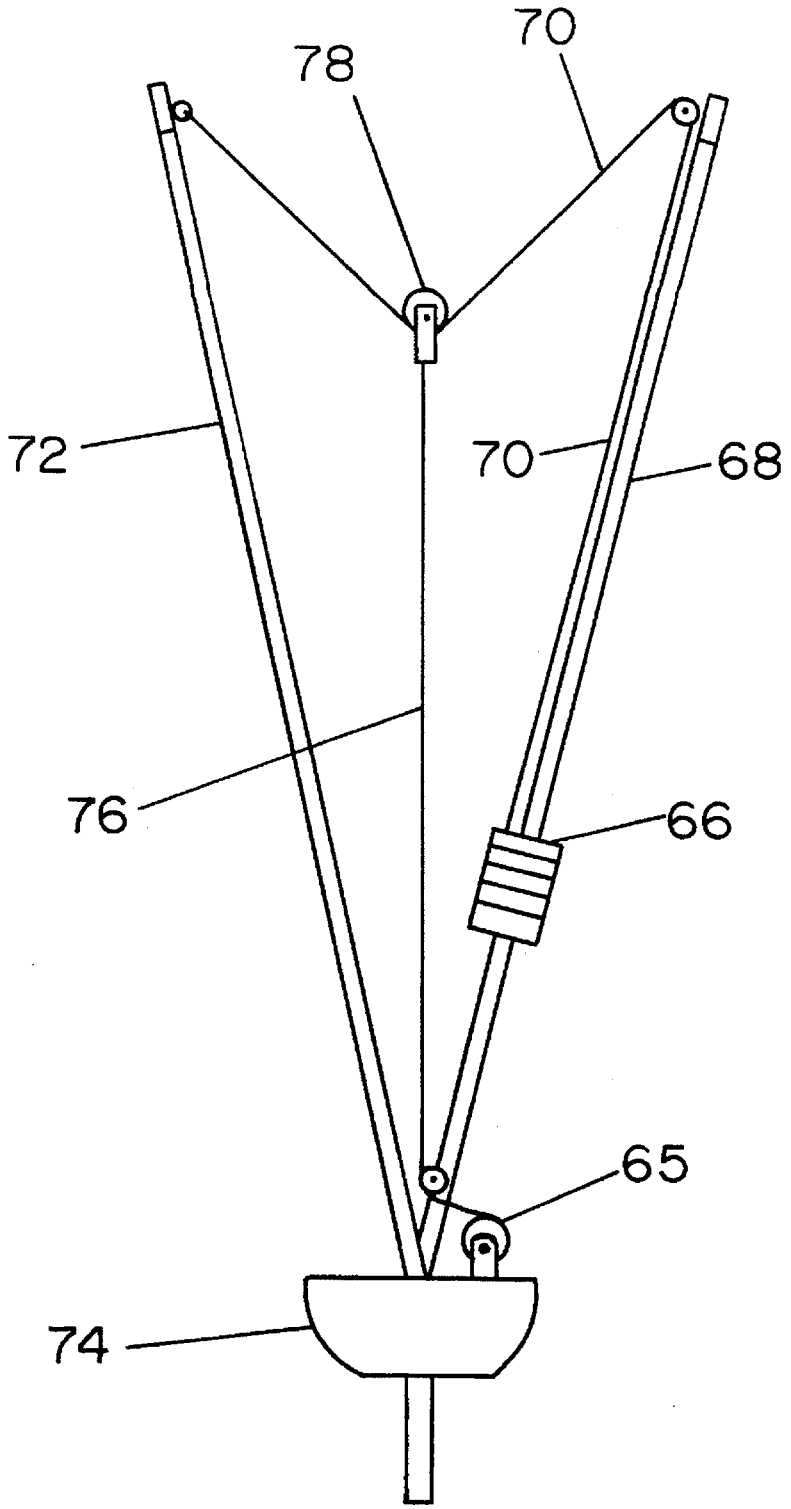
FIG. 6 is a simplified diagram of an alternate embodiment of the invention in which a winch is utilized to vary the position of the weights on the pole.

FIG. 6 is a simplified diagram of an alternate embodiment of the invention in which winch 65 is utilized to vary the position of the weights 66 on the pole 68. The essential difference between FIG. 6 and FIG. 1 is that cable 70 which interconnects mast 72 with weights 66, can be effectively shortened or lengthened, and weights 66 moved farther out from or closer to the keel of hull 74, by controlling the length of second cable 76 with winch 65. This control by winch 64 is essentially independent of the angle between mast 72 and pole 66, since that angle is largely controlled by the resistance of the spring (48 on FIG. 2) which counteracts the tilt of the mast.

However, as second cable 76 is pulled in by winch 65, weights 66 will move up pole 68 and thereby move farther from the keel of hull 74. For the opposite effect, as cable 76 is released from winch 65 weights 66 will move down pole 66 by the force of gravity and the thus their ballasting effect will be reduced as they move closer to the keel of hull 74.

To accommodate to the changing separation of mast 72 and pole 58, winch cable 76 is interconnected with weight cable 70 by means of trolley 78 which rolls along cable 70 so that it is always located midway between mast 72 and pole 68.

It should be appreciated that it is advantageous that the length of weight cable 70 in FIG. 6 be greater than the length of weight cable 26 in FIG. 1. An appropriate initial position for weights 66 in FIG. 6, when mast 72 and pole 68 are both vertical, is that weights 66 be located approximately midway up pole 68, and that trolley 78 be located at approximately the same height above the deck by winch cable 76. Such an arrangement provides immediate substantial windward ballast when mast 72 tilts, and it also permits adjustment of the ballast in either direction. If there is an immediate requirement for reduction in the effective ballast, winch 65 need only be operated to lower weights 66 on pole 68, while if an increase in effective ballast is required, winch 65 can be operated to lift weights 66 farther up pole 66.

With the more sophisticated embodiment of the invention shown in FIG. 6, the crew of a sailboat can therefore control the amount of ballast counteracting the wind forces on the sail, not only in incremental steps by the addition or removal of weight sections from weight 66, but also in an essentially continuous manner by the the control of winch 65.

An experienced crew can thereby continuously maintain the sailboat at even keel, and, particularly with the added benefit of the larger and better optimized foresails available because there are no lateral stays on the mast, keep the hull planing on the water surface and thus obtain higher speeds.

The purpose of the invention is to open up opportunities for the naval architect to design a wide variety of crafts and devices. These range from a simple add-on clamped to the sides of an ordinary canoe to a rig for a motor sailor. In the latter situation the objective is to add the stability and comfort that a modest exposure of sail offers to such a vessel without the undesirable angle of heel which is the result of such a sail.

The greatest opportunity for the naval architect is to design small sailing boats with entirely new characteristics. The advantages of the invention result in some cases in boats of much finer line. In other cases the design yields higher spars and greater sail area.

The position of the pivot points for the mast and pole change the sailing qualities and stability very substantially. For instance, pivoting the mast allows attaching a weight below the pivot point which automatically moves the center of gravity to windward of the center of buoyancy. Furthermore, when the mast is rigidly attached to the keel through a casing such as is used for a centerboard, the keel also moves, notably enhancing the movement of the center of gravity.

Thus, the naval architect is liberated from ancient restraints and given opportunities that have have been previously denied by the tradition which decrees that masts must be laterally stayed.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, in FIG. 2, more complex gearing can be used to permit pole 20 to tilt at multiples of the angle of tilt of mast 18 in order to create a greater shifting ballast effect. Furthermore, as noted previously, many devices other than simple spring 33 are available to provide the variable force to counteract the tilt of mast 18.

What is claimed as new and for which Letters Patent of the United States are desired to be secured is:

1. A sailing vessel comprising:

a hull with a keel;

a mast without lateral stays, the mast being attached to the hull by a first attachment means which permits the mast to tilt in a plane perpendicular to the keel of the hull;

a boom attached to the mast;

a sail attached to the mast and to the boom;

a variable force means attached to the mast and applying to the mast a counteracting force which resists the tilt of the mast, with the counteracting force increasing as the mast's angle to the vertical increases;

a motion reversing means interconnected with the mast so that tilting of the mast causes the motion reversing means to move;

a pole attached to the hull by a second attachment means which permits the pole to tilt in a plane perpendicular to the keel of the hull, the pole also being interconnected to the motion reversing means so that the pole is vertical when the mast is vertical and so that any tilting of the mast causes the pole to tilt in a direction opposite from the mast;

a weight attached to the pole so that the weight is moveable along the length of the pole; and a first line attached to the weight and to the mast and moving through a pulley attached to the pole above the weight so that, as the top of the mast and the top of the pole separate, the weight moves up the pole.

2. The sailing vessel of claim 1 wherein the hull has a flat bottom.

3. The sailing vessel of claim 1 wherein the weight comprises at least two individual weights and at least one of the individual weights may be separately removed from the pole.

4. The sailing vessel of claim 1 wherein the pulley is attached to a swivel connector at the top of the pole.

5. The sailing vessel of claim 1 wherein the line is attached to the mast at a swivel connector at the top of the mast.

6. The sailing vessel of claim 1 wherein the weight is attached to the pole by riding on a weight holder and a portion of the weight holder moves within a slot in the pole.

7. The sailing vessel of claim 1 further including a trolley riding on the first line, with the trolley located between the mast and the pole, and a second line attached to the trolley and to a winch, so that as the second line is drawn into the winch, the weight moves up the pole.

8. The sailing vessel of claim 1 wherein the motion reversing means is a set of gears.

* * * * *